US008516930B2

(12) United States Patent
Tsai

(10) Patent No.: US 8,516,930 B2
(45) Date of Patent: Aug. 27, 2013

(54) FASTENER-DRIVING SLEEVE ASSEMBLY

(76) Inventor: Jen-Chu Tsai, Taichung (TW)

( * ) Notice: Subject to any disclaimer, the term of this patent is extended or adjusted under 35 U.S.C. 154(b) by 373 days.

(21) Appl. No.: 12/908,092

(22) Filed: Oct. 20, 2010

(65) Prior Publication Data

US 2011/0100167 A1 May 5, 2011

(30) Foreign Application Priority Data

Oct. 30, 2009 (TW) ..... 98136927 A

(51) Int. Cl.
*B25B 13/06* (2006.01)

(52) U.S. Cl.
USPC ..... 81/124.6; 81/125

(58) Field of Classification Search
USPC ..... 81/124.5, 124.6, 125
See application file for complete search history.

(56) References Cited

U.S. PATENT DOCUMENTS

| | | | | |
|---|---|---|---|---|
| 1,157,567 | A | 7/1969 | Johansson | |
| 7,454,998 | B1 | 11/2008 | Hsieh | |
| 7,841,261 | B2 * | 11/2010 | Milligan et al. | 81/121.1 |
| 2005/0039581 | A1 | 2/2005 | Eggert et al. | |
| 2005/0044994 | A1 * | 3/2005 | Hsien | 81/60 |

FOREIGN PATENT DOCUMENTS

| | | | |
|---|---|---|---|
| CN | 201147910 | | 11/2008 |
| DE | 102007031914 | A1 | 1/2009 |
| EP | 0565919 | A1 | 3/1993 |
| GB | 1157567 | A | 9/1969 |
| JP | 06008154 | | 1/1994 |
| JP | 10249743 | | 9/1998 |
| WO | 8404721 | A1 | 12/1984 |
| WO | 9934959 | A1 | 7/1999 |

OTHER PUBLICATIONS

European Patent Office, International Search Report issued in corresponding EP application No. 10188269.4-1251 dated Jan. 21, 2011.
European Patent Office, International Search Report issued in corresponding PCT Application No. PCT/AT84/0019 dated Sep. 14, 1984.
European Patent Office, International Search Report issued in corresponding PCT Application No. PCT/AT84/00019 dated Oct. 9, 1984.

* cited by examiner

*Primary Examiner* — Robert Scruggs
(74) *Attorney, Agent, or Firm* — Trop, Pruner & Hu, P.C.

(57) ABSTRACT

A fastener-driving sleeve assembly is driven by a driving tool to rotate a fastener, and includes a connecting sleeve and a reinforcing ring. The connecting sleeve has a tool-connecting portion and a fastener-connecting portion. The tool-connecting portion has a head-receiving hole engaging fittingly a driving head of the driving tool. The fastener-connecting portion has a fastener-receiving hole engaging fittingly the fastener. The reinforcing ring is sleeved fixedly on the fastener-connecting portion of the connecting sleeve. The reinforcing ring and the connecting sleeve have complementary interengaging surfaces. Preferably, the connecting sleeve and the reinforcing ring are made of two different metal materials, respectively.

9 Claims, 8 Drawing Sheets

FASTENER-DRIVING SLEEVE ASSEMBLY

CROSS-REFERENCE TO RELATED APPLICATION

This application claims priority of Taiwanese Application No. 098136927, filed on Oct. 30, 2009.

BACKGROUND OF THE INVENTION

1. Field of the Invention

This invention relates to a sleeve for driving a fastener, and more particularly to a durable fastener-driving sleeve assembly driven by a rotary driving tool to rotate a fastener.

2. Description of the Related Art

Referring to FIG. 1, a conventional sleeve 1 has a non-circular head-receiving hole 11 engaging fittingly a driving head 102 of a spanner 101, and a non-circular fastener-receiving hole 12 engaging fittingly a bolt 103. A spring-biased ball 104 is disposed on the driving head 102. The aforesaid conventional sleeve 1 suffers from a disadvantage. That is, when used for a long time period, corners of an inner peripheral surface of the sleeve 1 defining the fastener-receiving hole 12 are easily damaged. To solve this problem, the sleeve 1 can be made of a high-rigidity material. However, this results in a substantial increase in the manufacturing cost of the sleeve 1.

SUMMARY OF THE INVENTION

The object of this invention is to provide a durable fastener-driving sleeve assembly that is inexpensive to manufacture.

Accordingly, a fastener-driving sleeve assembly of this invention is driven by a driving tool to rotate a fastener, and includes a connecting sleeve and a reinforcing ring. The connecting sleeve has a tool-connecting portion and a fastener-connecting portion. The tool-connecting portion has a head-receiving hole engaging fittingly a driving head of the driving tool. The fastener-connecting portion has a fastener-receiving hole engaging fittingly the fastener. The reinforcing ring is sleeved fixedly on the fastener-connecting portion of the connecting sleeve. The reinforcing ring and the connecting sleeve have complementary interengaging surfaces.

Preferably, the reinforcing ring is made of a high-rigidity metal material to reduce deformation of the fastener-connecting portion of the connecting sleeve during use of the fastener-driving sleeve assembly, and the connecting sleeve is made of a metal material having rigidity slightly smaller than that of the reinforcing ring to reduce the manufacturing cost of the fastener-driving sleeve assembly.

BRIEF DESCRIPTION OF THE DRAWINGS

These and other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
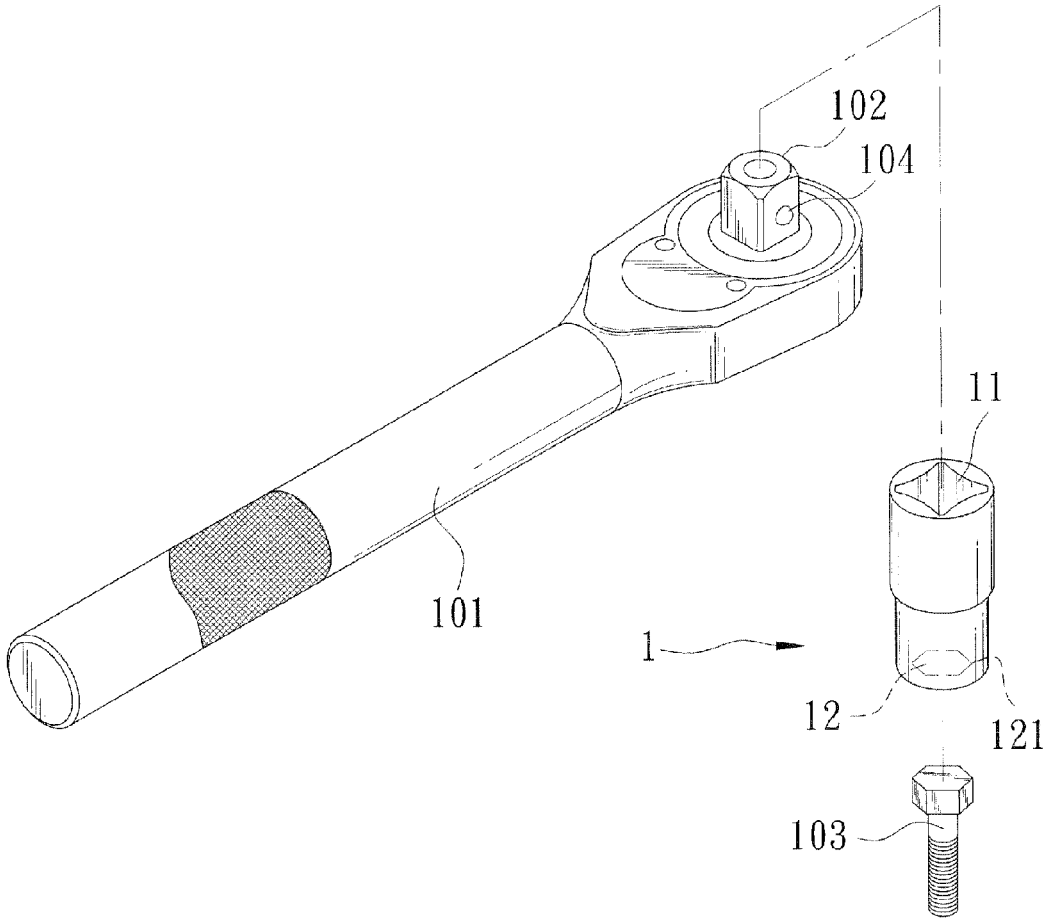
FIG. 1 PRIOR ART
FIG. 1 is an exploded perspective view of a spanner, a conventional sleeve, and a bolt.

Before the present invention is described in greater detail in connection with the preferred embodiments, it should be noted that similar elements and structures are designated by like reference numerals throughout the entire disclosure.

Figure 2:
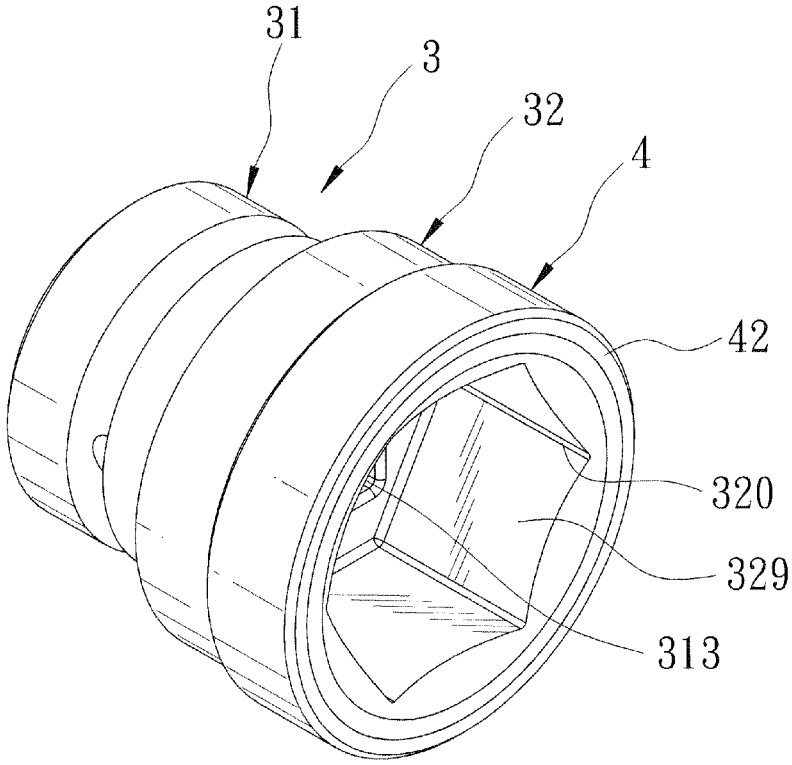
FIG. 2 is a perspective view of the first preferred embodiment of a fastener-driving sleeve assembly according to this invention.

Referring to FIG. 2, the first preferred embodiment of a fastener-driving sleeve assembly according to this invention is driven by a rotary driving tool (such as a spanner, a pneumatic tool, an electrical tool, an automated machine, etc.) to rotate a fastener (not shown), such as bolt, a nut, etc. The fastener-driving sleeve assembly includes a connecting sleeve 3 and a reinforcing ring 4.

Figure 3:
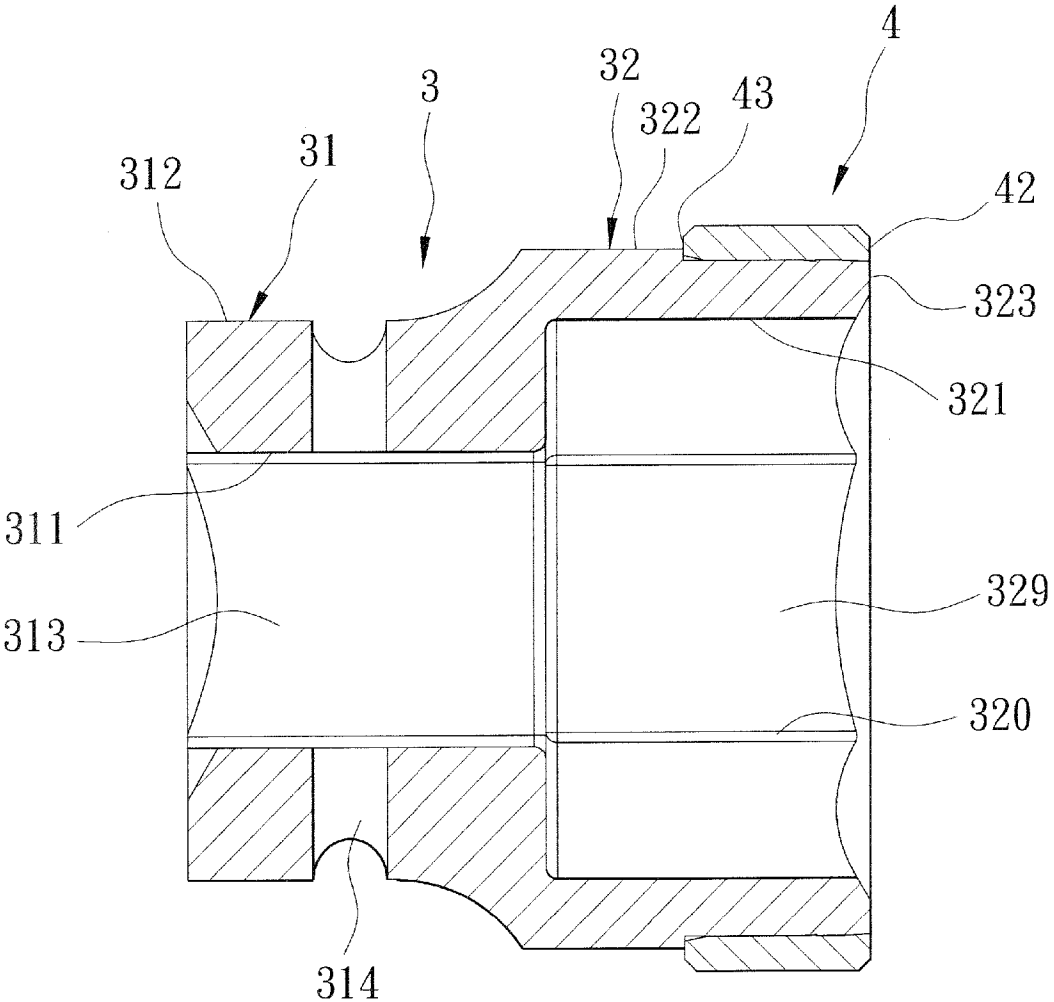
FIG. 3 is an assembled sectional view of the first preferred embodiment.
Figure 4:
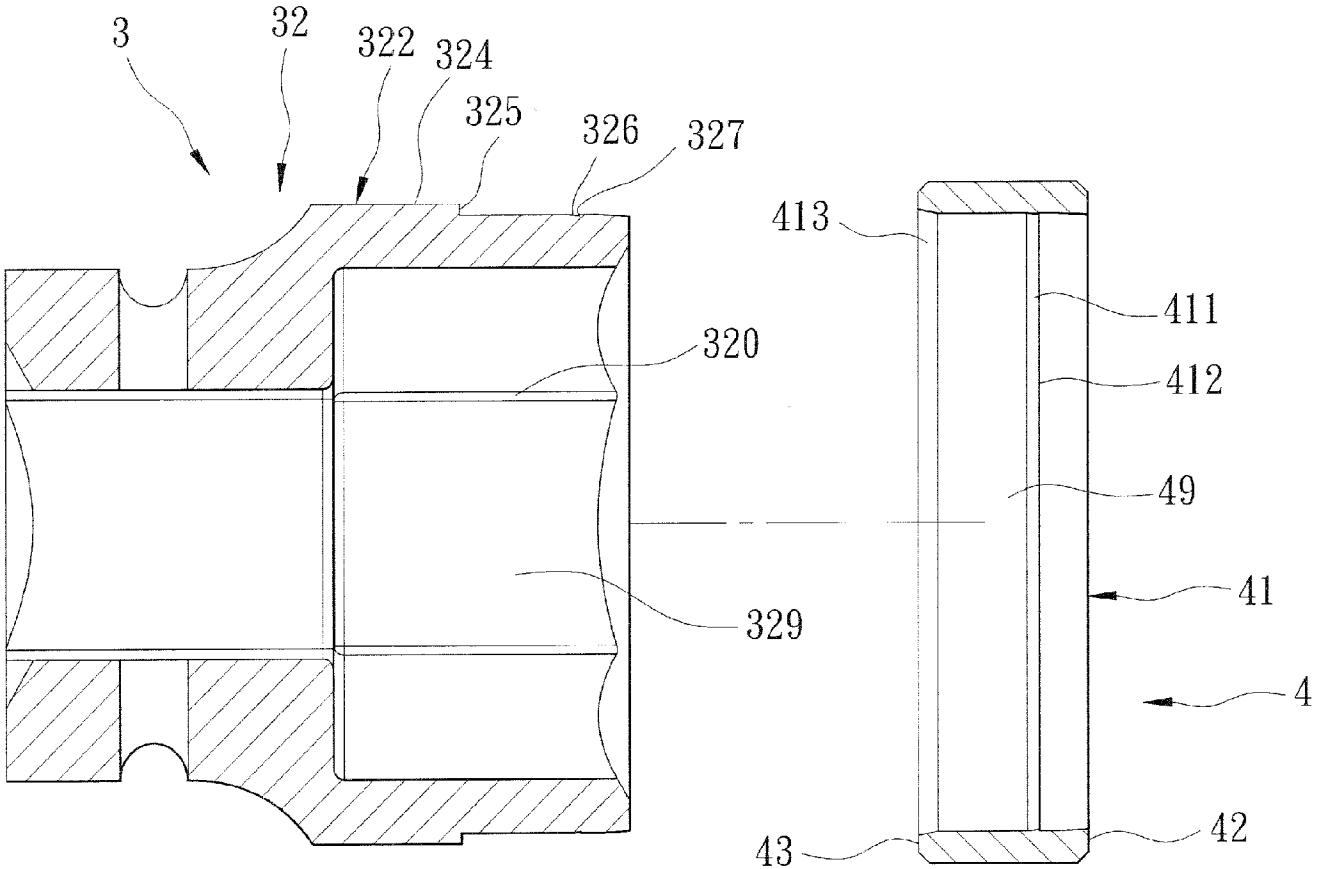
FIG. 4 is an exploded sectional view of the first preferred embodiment.
Figure 5:
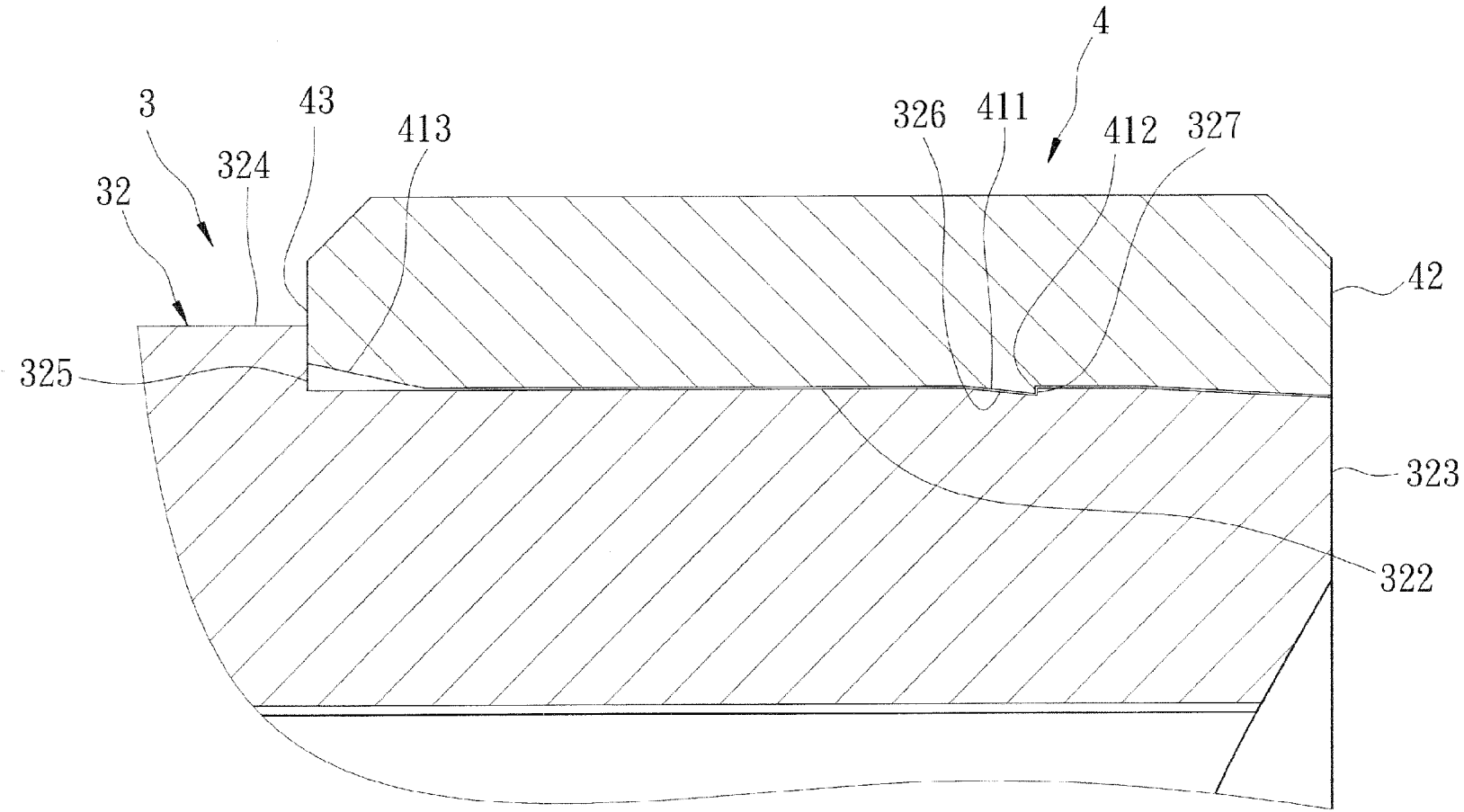
FIG. 5 is a fragmentary assembled sectional view of the first preferred embodiment, illustrating complementary interengaging surfaces of a connecting sleeve and a reinforcing ring.

With further reference to FIGS. 3, 4, and 5, the connecting sleeve 3 is made of metal, and includes a tool-connecting portion 31 and a fastener-connecting portion 32. The tool-connecting portion 31 is driven by a driving head of the rotary driving tool (not shown), and has an inner peripheral surface 311, and an outer peripheral surface 312. The inner peripheral surface 311 defines a head-receiving hole 313 that is generally rectangular in cross-section. Two ball-receiving holes 314 extend from the inner peripheral surface 311 into the outer peripheral surface 312 for receiving a spring-biased ball of the driving head of the rotary driving tool.

The fastener-connecting portion 32 is operable to drive rotation of the fastener, and has an inner peripheral surface 321, an outer peripheral surface 322, and an end surface 323 interconnecting the inner and cuter peripheral surfaces 321, 322. The inner peripheral surface 321 defines a fastener-receiving hole 329 that is generally hexagonal in cross-section. The fastener-connecting portion 32 further has a flange 324 extending radially and outwardly therefrom to define an annular large shoulder surface 325, and a frustoconical intermediate portion 326 defining an annular small shoulder surface 327 facing the large shoulder surface 325. The frustoconical intermediate portion 326 increases gradually in diameter in a direction toward the large shoulder surface 325. In this embodiment, the small shoulder surface 327 is disposed at an end of the frustoconical intermediate portion 326 distal from the large shoulder surface 325, and the distance between the frustoconical intermediate portion 326 and the large shoulder surface 325 is greater than that between the frustoconical intermediate portion 326 and the end surface 323. Preferably, the frustoconical intermediate portion 326 of the fastener-connecting portion 32 of the connecting sleeve 3 has an axial length that is between 0.05 mm and 0.1 mm.

The reinforcing ring 4 is made of a metal material. In this embodiment, the material of the reinforcing ring 4 is different from that of the connecting sleeve 3. In practice, the rigidity of the reinforcing ring 4 is higher than that of the connecting sleeve 3. The reinforcing ring 4 has an inner peripheral surface 41 abutting against the outer peripheral surface 322 of the fastener-connecting portion 32 of the connecting sleeve 3, an outer end surface 42 aligned with the end surface 323 of the connecting sleeve 3, and an inner end surface 43 opposite to the outer end surface 42 and abutting against the large shoulder surface 325 of the connecting sleeve 3.

The inner peripheral surface 41 defines a central bore 49 having a frustoconical intermediate portion 411 that engages fittingly the frustoconical intermediate portion 326 of the connecting sleeve 3. That is, the connecting sleeve 3 and the reinforcing ring 4 have complementary interengaging surfaces. The reinforcing ring 4 further has an annular shoulder surface 412 defining an end of the frustoconical intermediate portion 411 and abutting against the small shoulder surface 327 of the connecting sleeve 3.

Since the inner end surface 43 and the shoulder surface 412 abut respectively against the large and small shoulder surfaces 325, 327, removal of the reinforcing ring 4 from the connecting sleeve 3 can be prevented.

The reinforcing ring 4 further has a frustoconical guiding surface 413 that defines an inner end portion of the central bore 49 proximate to the large shoulder surface 325 of the connecting sleeve 3. The diameter of the inner end portion of the central bore 49 increases gradually in a direction toward the large shoulder surface 325 to thereby allow the reinforcing ring 4 to be sleeved easily onto the fastener-connecting portion 32 of the connecting sleeve 3.

Figure 6:
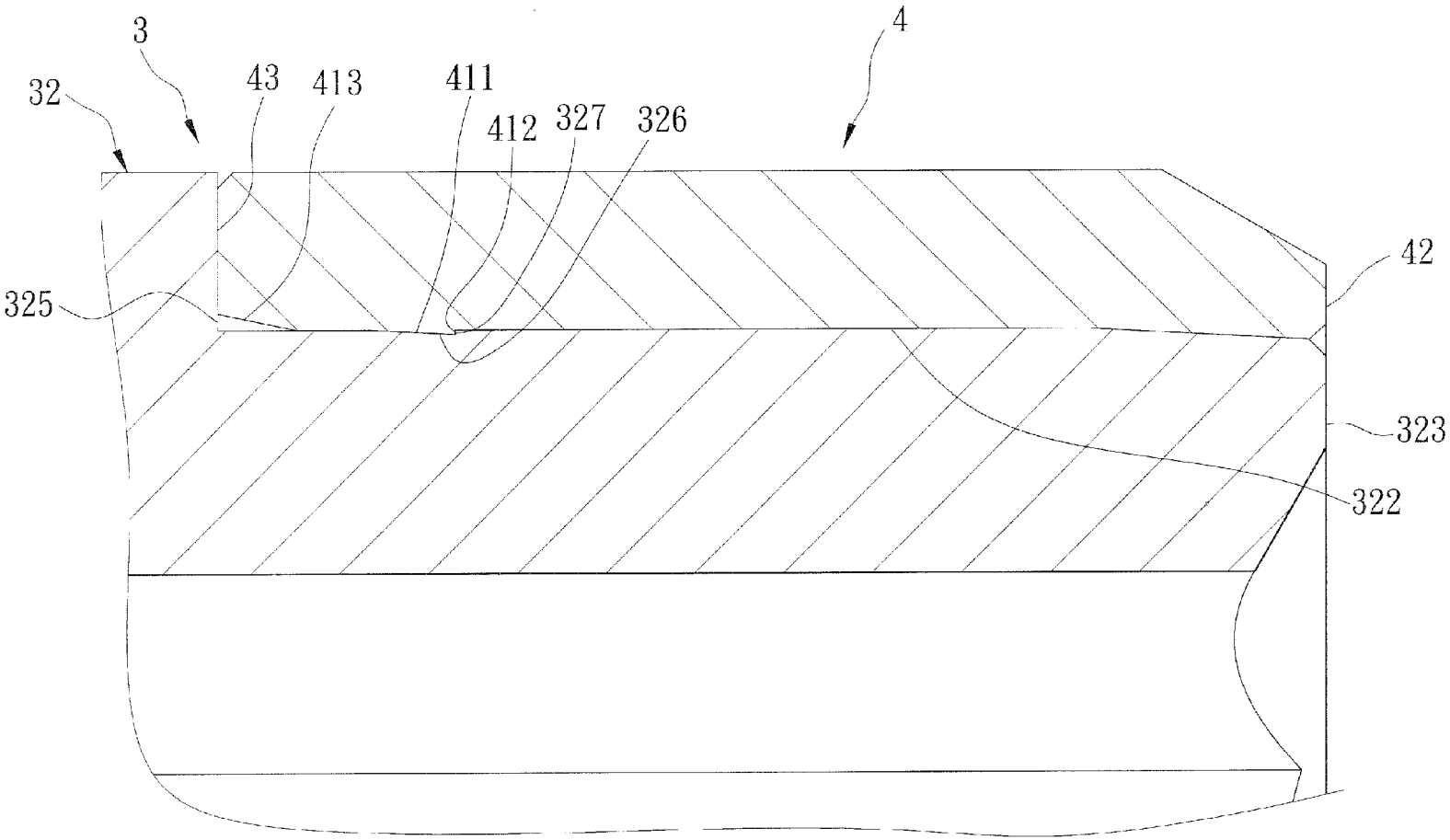
FIG. 6 is a fragmentary assembled sectional view of the second preferred embodiment of a fastener-driving sleeve assembly according to this invention.

FIG. 6 illustrates the second preferred embodiment of a fastener-driving sleeve assembly according to this invention, which is different from the first preferred embodiment in that, the distance between the frustoconical intermediate portion 326 and the large shoulder surface 325 is smaller than that between the frustoconical intermediate portion 326 and the end surface 323.

Figure 7:
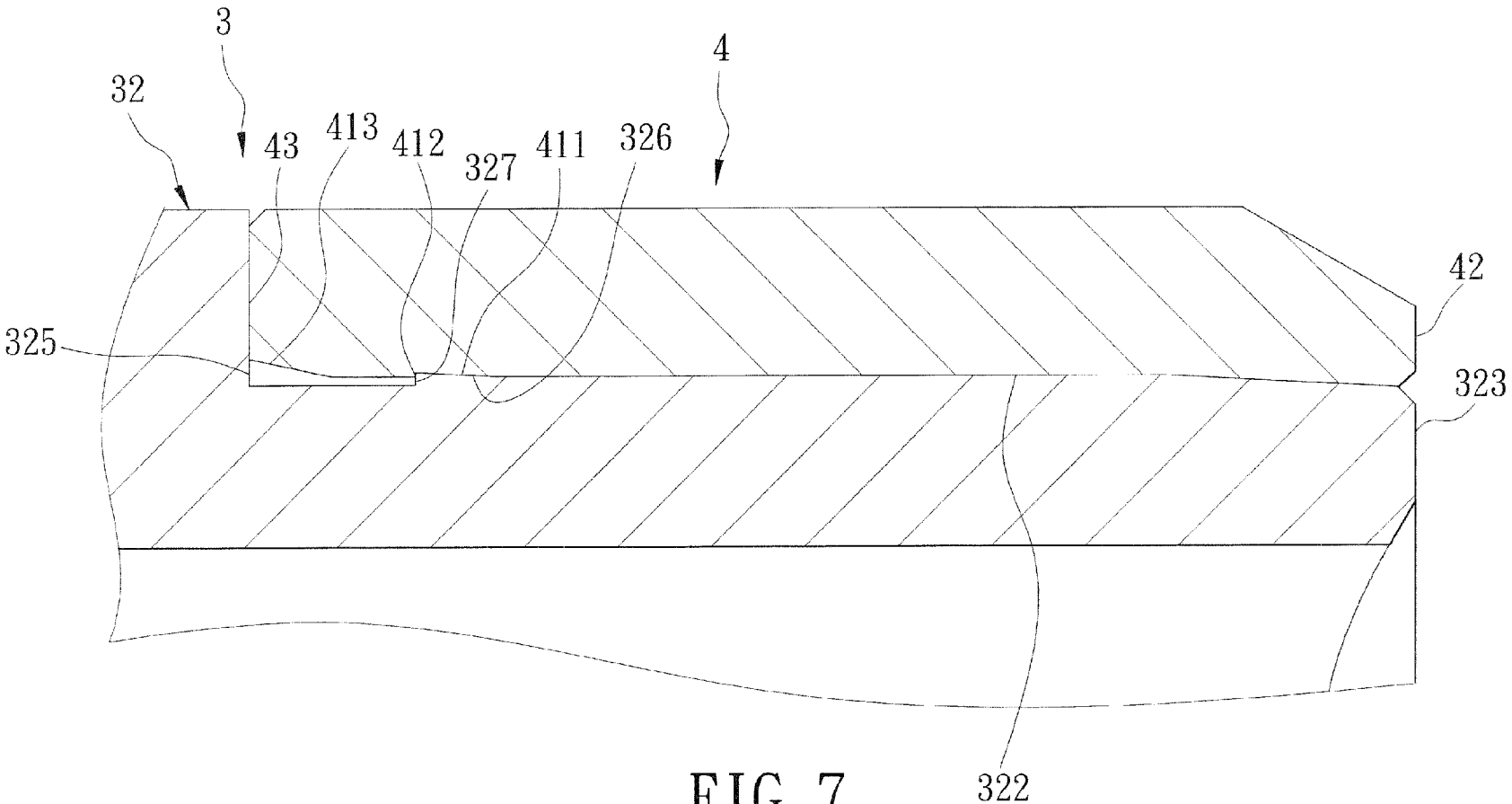
FIG. 7 is a fragmentary assembled sectional view of the third preferred embodiment of a fastener-driving sleeve assembly according to this invention.
Figure 8:
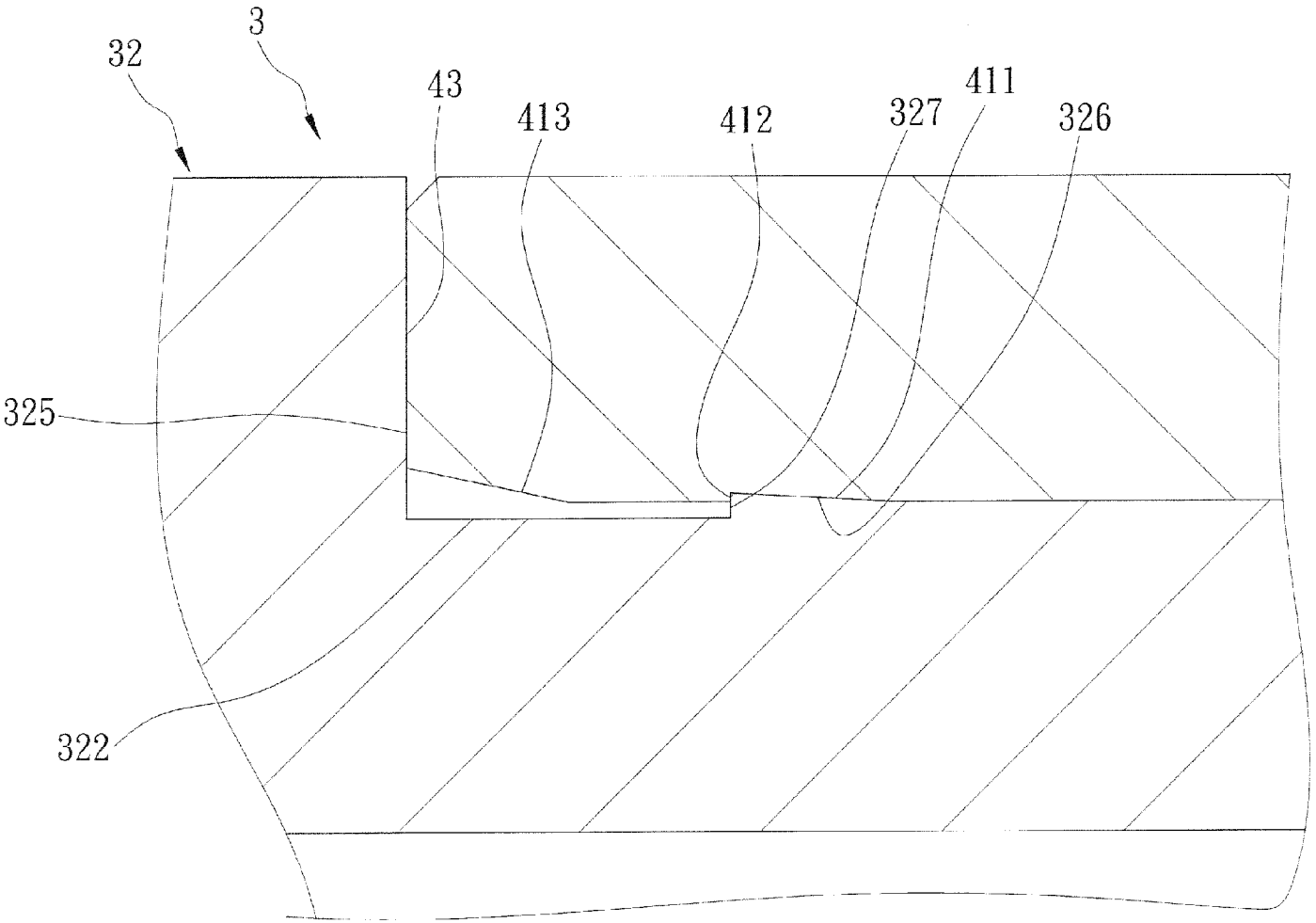
FIG. 8 is a fragmentary assembled sectional view of the third preferred embodiment, illustrating a frustoconical intermediate portion of a fastener-connecting portion of a connecting sleeve.

FIGS. 7 and 8 illustrate the third preferred embodiment of a fastener-driving sleeve assembly according to this invention, which is different from the second preferred embodiment in that the small shoulder surface 327 is disposed at an end of the frustoconical intermediate portion 326 proximate to the large shoulder surface 325.

In view of the above, the fastener-driving sleeve assembly of this invention has the following advantages:

1. Due to the reinforcing function of the reinforcing ring 4, damage to corners 320 (see FIG. 3) of the inner peripheral surface 321 of the fastener-connecting portion 32 of the connecting sleeve 3 can be reduced during use of the fastener-driving sleeve assembly, thereby resulting in a durable structure.
2. The reinforcing ring 4 is made of a high-rigidity metal material to reduce deformation of the fastener-connecting portion 32 of the connecting sleeve 3 during use of the fastener-driving sleeve assembly. The connecting sleeve 3 is made of a metal material having rigidity slightly smaller than that of the reinforcing ring 4 to reduce the manufacturing cost of the fastener-driving sleeve assembly and to enable the reinforcing ring 4 to be sleeved thereon.
3. The outer peripheral surfaces of the connecting sleeve 3 and the reinforcing ring 4 can be of two different colors, respectively, to improve an outer appearance of the fastener-driving sleeve assembly.

With this invention thus explained, it is apparent that numerous modifications and variations can be made without departing from the scope and spirit of this invention. It is therefore intended that this invention be limited only as indicated by the appended claims.

I claim:

1. A fastener-driving sleeve assembly adapted to be driven by a rotary driving tool to thereby rotate a fastener, the rotary driving tool having a non-circular driving head, said fastener-driving sleeve assembly comprising;

a connecting sleeve made of metal and having a tool-connecting portion and a fastener-connecting portion, said tool-connecting portion having a head-receiving hole adapted to engage fittingly the driving head of the rotary driving tool so as to allow for co-rotation of said connecting sleeve with the driving head, said fastener-connecting portion having a fastener-receiving hole adapted to engage fittingly the fastener so as to allow for co-rotation of the fastener with said connecting sleeve; and a reinforcing ring made of metal and sleeved fixedly on said fastener-connecting portion of said connecting sleeve:

wherein:

said fastener-connecting portion of said connecting sleeve further has a flange extending radially and outwardly therefrom to define an annular large shoulder surface, and a frustoconical intermediate portion defining an annular small shoulder surface facing said large shoulder surface; and said reinforcing ring having a front end surface abutting against said large shoulder surface, and defines a central bore having a frustoconical intermediate portion that engages fittingly said frustoconical intermediate portion of said connecting sleeve, said reinforcing ring further having an annular shoulder surface that defines an end of said frustoconical intermediate portion of said central bore and that abuts against said small shoulder surface of said connecting sleeve, such that a portion of said reinforcing ring disposed between said front end surface and said annular shoulder surface is confined between said large and small shoulder surfaces of said connecting sleeve, so as to prevent removal of said reinforcing ring from said connecting sleeve.

2. The fastener-driving sleeve assembly as claimed in claim 1, wherein said reinforcing ring and said connecting sleeve has complementary interengaging surfaces.

3. The fastener-driving sleeve assembly as claimed in claim 1, wherein said reinforcing ring and said connecting sleeve are made of two different metal materials, respectively.

4. The fastener-driving sleeve assembly as claimed in claim 1, wherein said reinforcing ring has a frustoconical guiding surface that defines an inner end portion of said central bore proximate to said large shoulder surface of said connecting sleeve, such that said inner end portion of said central bore increases gradually in diameter in a direction toward said large shoulder surface, thereby allowing said reinforcing ring to be sleeved easily onto said fastener-connecting portion of said connecting sleeve.

5. The fastener-driving sleeve assembly as claimed in claim 1, wherein said frustoconical intermediate portion of said fastener-connecting portion of said connecting sleeve has a diameter that increases gradually in a direction toward said large shoulder surface.

6. The fastener-driving sleeve assembly as claimed in claim 5, wherein said small shoulder surface is disposed at an end of said frustoconical intermediate portion of said fastener-connecting portion of said connecting sleeve distal from said large shoulder surface.

7. The fastener-driving sleeve assembly as claimed in claim 5, wherein said small shoulder surface is disposed at an end of said frustoconical intermediate portion of said fastener-connecting portion of said connecting sleeve proximate to said large shoulder surface.

8. The fastener-driving sleeve assembly as claimed in claim 1, the driving head of the rotary driving tool being provided with a spring-biased ball, wherein said tool-connecting portion of said connecting sleeve has an outer peripheral surface that is formed with at least one ball-receiving hole adapted for receiving the spring-biased ball.

9. The fastener-driving sleeve assembly as claimed in claim 1, wherein said frustoconical intermediate portion of said fastener-connecting portion of said connecting sleeve has an axial length that is between 0.05 mm and 0.1 mm.

* * * * *